US009687079B1

(12) United States Patent
Grove

(10) Patent No.: US 9,687,079 B1
(45) Date of Patent: Jun. 27, 2017

(54) BACK SUPPORT ASSEMBLY FOR THE BACK OF A CHAIR

(71) Applicant: James E. Grove, Marina Del Rey, CA (US)

(72) Inventor: James E. Grove, Marina Del Rey, CA (US)

( * ) Notice: Subject to any disclaimer, the term of this patent is extended or adjusted under 35 U.S.C. 154(b) by 0 days.

(21) Appl. No.: 15/137,384

(22) Filed: Apr. 25, 2016

(51) Int. Cl.
*A47C 7/56* (2006.01)
*A47C 7/44* (2006.01)

(52) U.S. Cl.
CPC ..... *A47C 7/566* (2013.01); *A47C 7/445* (2013.01)

(58) Field of Classification Search
CPC ..... A47C 7/566
USPC ..... 297/284.4
See application file for complete search history.

(56) References Cited

U.S. PATENT DOCUMENTS 4,040,661 A * 8/1977 Hogan ..... A47C 1/036 297/284.4
6,554,360 B1 * 4/2003 Wilke ..... B60N 2/0284 297/284.4 X
7,794,017 B2 * 9/2010 Kan ..... A47C 1/03255 297/284.4
9,192,234 B2 11/2015 Grove

* cited by examiner

*Primary Examiner* — Anthony D Barfield
(74) *Attorney, Agent, or Firm* — Morland C. Fischer

(57) ABSTRACT

A back support assembly for the back of a chair that rocks back and forth. The back of the chair includes a front that is spaced from and pivotally coupled to a rear. The front of the chair back is rotatable towards and away from the back of a user. A back support pushing arm within the back of the chair is pivotally coupled to the rear of the chair back and rotatable between a first position at which to apply a pushing force against the front of the chair back when the chair rocks forwards and a second position when the user leans back, the chair rocks backwards, and the front of the chair rotates towards the rear. A force generating strap within the chair back contacts and urges the back support pushing arm to rotate to the first position lying against the front of the chair back.

20 Claims, 4 Drawing Sheets

BACK SUPPORT ASSEMBLY FOR THE BACK OF A CHAIR

BACKGROUND OF THE INVENTION

1. Field of the Invention

This invention relates to a back support assembly that is located inside the back of a chair of the kind that rocks back and forth and is typically found in a home or office adjacent a work surface. The back support assembly includes a curved back support that is rotatable in a first direction when the chair rocks forwards at which to protrude outwardly from the chair back towards the back of a user and in an opposite direction inwardly of the chair back when the chair rocks backwards at which to allow the user to lean completely back and recline against the chair back.

2. Background Art

A wide variety of chairs have been used in a home or an office to enable a user to be seated adjacent a work surface such as a desk. In this case, the user can access a computer, a book, a writing pad, etc. which lays upon the work surface so that the user can work while seated. Some chairs are adapted to rock back and forth in response to the user shifting his weight backwards and forwards. With the chair rocked forwards, the user's back is located close to the work surface during which work can be accomplished. When the chair rocks backwards, the user's back is correspondingly reclined and tilted away from the work surface to enable the user to relax.

A common problem with such conventional home and office chairs occurs when the chair rocks forward and the user tries to hold his back erect and close to the work surface. In particular, even when the back of the chair stands upright, the back of the user is often spaced forwardly from the chair back. Therefore, the chair back offers no support for the user's back throughout those times when the user is working. Consequently, the user's back posture may suffer and, especially during long periods of work, the user may experience lower back pain and discomfort.

What would therefore be desirable is a chair which overcomes this problem so that the user's back will be adequately supported by the back of the chair, whereby a proper posture is maintained and comfort enhanced when the chair rocks forward and the user's back is spaced from the chair back. Reference may be made to my pending patent application Ser. No. 14/051,251 filed Oct. 10, 2013 and to my U.S. Pat. No. 9,192,234 issued Nov. 24, 2015 for examples of a back support located within the back of a chair to improve the posture and comfort of one seated in the chair.

SUMMARY OF THE INVENTION

In general terms, a back support assembly is disclosed to be located inside the back of a chair of the kind that has particular application for use in a home or office so that a user can be seated adjacent a work surface (e.g., a desk or a table) with his back erect. The chair is of the kind that rocks back and forth when the user shifts his weight backwards and forwards. The back and the seat of the chair are connected together so as to tilt backwards and forwards with one another as the chair rocks back and forth. The front of the back of the chair includes a rigid (e.g., plywood) back support having a curved configuration to conform to the back of the user. Located at the rear of the back of the chair opposite and spaced from the curved back support is a rigid (e.g., plywood) backing. The top of the back support is hingedly coupled to the top of the backing such that the back support is rotatable towards and away from the backing as the seat and back of the chair tilt backwards and forwards.

The back support assembly includes a force generating strap that stands upwardly within the chair back between the back support at the front of the chair back and the backing at the rear of the chair back. One end of the upstanding force generating strap is connected to the base of the chair at a conventional gas cylinder which lies below the seat of the chair. The opposite end of the force generating strap carries a pair of rollers that lay and roll on a low friction roller pad affixed to the inside of the backing at the rear of the chair back. The force generating strap remains stationary in the vertical direction relative to the back of the chair regardless of whether the chair seat and chair back tilt backwards or forwards.

The back support assembly also includes a rotatable back support pushing arm that extends within the chair back between the backing at the rear of the chair back and the back support at the front of the chair back. The back support pushing arm is received through an opening formed in the force generating strap such that the rollers of the force generating strap contact the rotatable back support pushing arm which lies adjacent and below the force generating strap. One end of the pushing arm is coupled to the inside of the backing at the rear of the chair back by a hinge. The opposite end of the pushing arm carries a pair of rollers that lie on and roll over the inside of the back support at the front of the chair back.

When the seat and back of the chair tilt forwards and the user sits erect in the chair, the rollers carried by the upstanding and vertically stationary force generating strap will be positioned near the bottom of the roller pad that is affixed to the backing at the rear of the chair back. At the same time, the rollers of the force generating strap press against and apply a pushing force to the rotatable back support pushing arm. The back support pushing arm is thusly rotated in a counter-clockwise direction at the hinge thereof towards a first position during which the rollers carried by the pushing arm ride downwardly along the front of the chair back and thereby cause the curved back support to rotate in a first direction away from the backing at the rear of the chair back so as to protrude outwardly from the front of the chair back and towards the back of the user.

When the user leans back in the chair and the seat and back of the chair tilt backwards, the backing of the chair back and the roller pad affixed to the inside of the backing move downwardly relative to the upstanding and vertically stationary force generating strap. In this case, the rollers carried by the force generating strap will be positioned upwardly on the roller pad of the backing. The force generated by the user leaning back in the chair causes the back support pushing arm to rotate in a clockwise direction towards a second position at which the rollers carried by the pushing arm roll up and along the inside of the back support at the front of the chair back. Accordingly, the curved back support will now rotate in an opposite direction towards the backing at the rear of the back of the chair to enable the user to lean completely back and recline comfortably against the chair back.

DESCRIPTION OF THE PREFERRED EMBODIMENT

Figure 1:
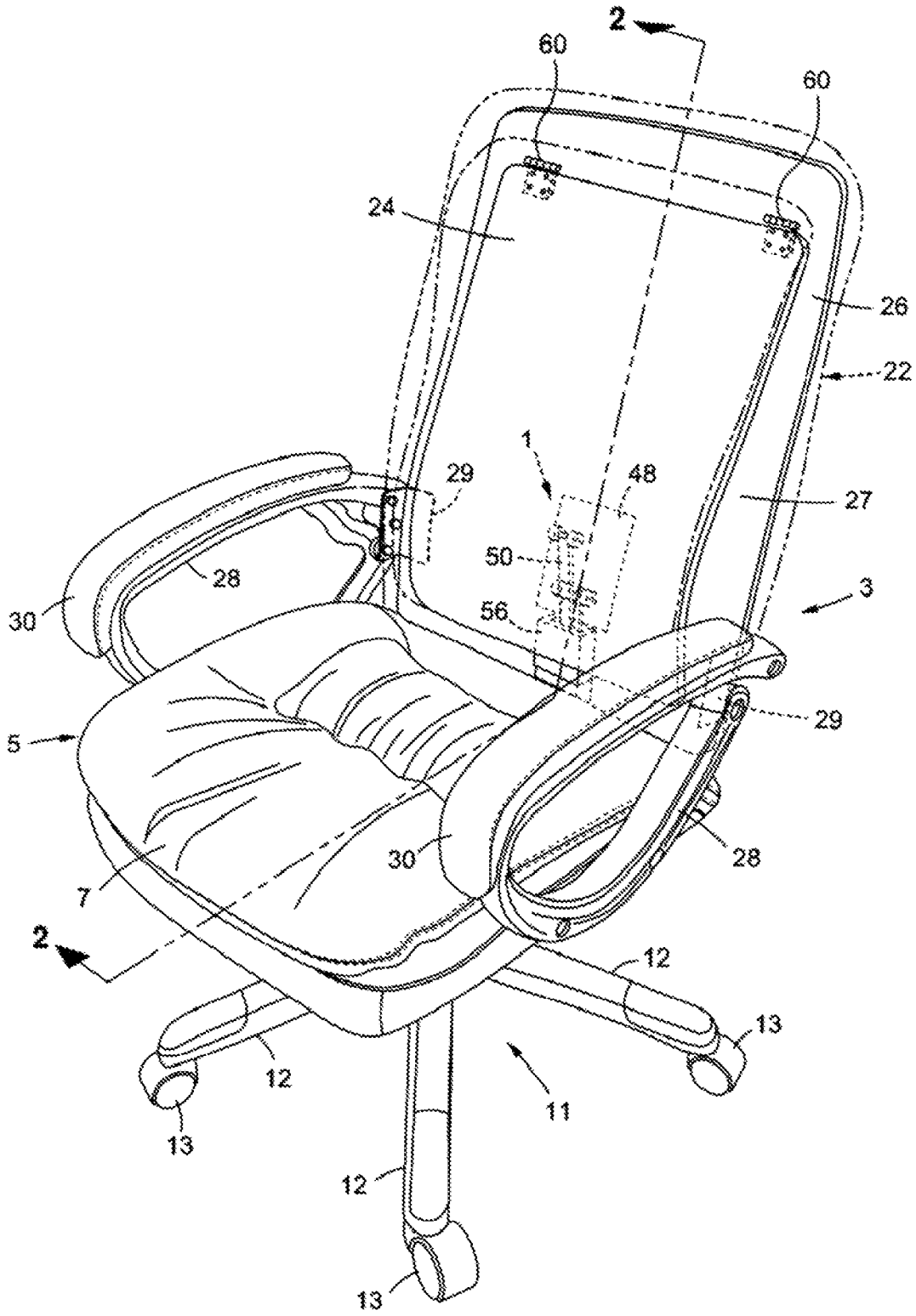
FIG. 1 shows a chair of the kind being adapted to rock back and forth and having a back support assembly according to a preferred embodiment of this invention located inside the back of the chair.

Referring concurrently to FIGS. 1-4 of the drawings, a back support assembly 1 is shown and disclosed for use at the back of a chair 3. The chair 3 is one that rocks back and forth and is of the kind that would be commonly found in a home or office to provide a comfortable seat for one working at a desk, a table or a similar work surface. However, the specific use of the chair 3 is not to be regarded as a limitation of this invention.

The chair 3 includes a seat 5 to support the weight of a user. The seat 5 has a cushion surface 7 secured atop a solid (e.g., plywood) seat support 9. A seat tilt control bracket 10 is affixed to and projects below the seat support 9. The chair seat 5 is held above the ground by a base 11 having a set of outstretched legs 12 to which respective rollers 13 are attached to permit the chair to be moved from place to place. A gas cylinder 14 extends between the base 10 and a gas cylinder receiver 16 that lies below the seat 5 and is affixed to the seat support 9 thereof. A conventional lever arm (not shown) cooperates with the gas cylinder 14 to enable the seat 3 to be selectively elevated above the ground to satisfy the needs of the user. A tension adjustment knob 20 that is accessible below the seat tilt control bracket 10 is rotated to enable the user to adjust the spring tension of the seat 5 depending upon the size and weight of the user.

The back support assembly 1 is located within the back 22 of the chair 3. As will soon be explained, and as an important advantage of this invention, the back support assembly 1 is moved in a first direction at which to protrude outwardly from the chair back 22 so as to lie against and support the user's back and thereby maintain a proper posture for enhancing the user's comfort when the chair 3 rocks forwards and the chair back 22 stands substantially vertical to enable the user to sit erect and close to the work surface (best shown in FIGS. 1 and 2). The back support assembly 1 is moved in an opposite direction inwardly of the chair back 22 so as to permit the user to lean completely back and recline against the chair back as the chair 3 rocks backwards at the seat tilt control bracket 10 and the seat 5 and chair back 22 rotate away from the work surface (best shown in FIG. 5).

The back 22 of the chair 3 within which the back support assembly 1 is located is coupled to and rotatable with the seat 5. The chair back 22 is preferably surrounded by a padded cover and/or upholstery 23. The back support assembly 1 of the back 22 of the chair 3 includes a back support 24 that is located at the front of the chair back and is preferably manufactured from a rigid (e.g., plywood) material to provide support for the user's back at all times whether the user leans forwards or backwards in the chair. The back support 24 has a curved, arcuate configuration so as to protrude outwardly towards and lay against the user's back when the chair back 22 tilts forwards to enable the user to be seated comfortably and close to the work surface. The rear of the chair back 22 includes a rigid (e.g., plywood) backing 26. The curved back support 24 of the back support assembly 1 is located opposite and spaced in front of the backing 26 of the chair back 22 by a gap 27 which has a size that varies as the chair back tilts back and forth.

The chair 3 has a pair of arms 28 (best shown in FIG. 1) located at opposite sides of the seat 5. The arms 28 are shown attached by fasteners to the seat support 9 of the seat 5 and by brackets 29 to the rigid backing 26 of the chair back 22. However, the manner and location at which the arms 28 are connected to the seat and back of the chair 3 is a matter of choice and forms no part of this invention. Nevertheless, it is to be understood that the seat 5 and the back 22 of the chair 3 rotate together relative to the base 11 as the chair rocks back and forth at the seat control bracket 10. An arm rest 30 is attached atop each of the pair of arms 28 upon which the arms of the user can be laid.

Details of the back support assembly 1 that is located within the back 22 of the chair 3 are now disclosed while continuing to refer to FIGS. 1-5 of the drawings. According to a preferred embodiment, the back support assembly 1 includes a strap support 34 (best shown in FIGS. 2 and 5) which is spaced below the seat support 9. One end of the strap support 34 is attached to the gas cylinder 14 at the base 11 of the chair 3 by means of a coupling ring 36 which surrounds the gas cylinder. The opposite end of the strap support 34 is connected to one end of a strap support extension 38 by a threaded pin of a hand-operated rotatable knob 40. The knob 40 is rotated by the user during assembly of the chair 3 in order to connect the strap support 34 and the strap support extension 38 together.

Figure 2:
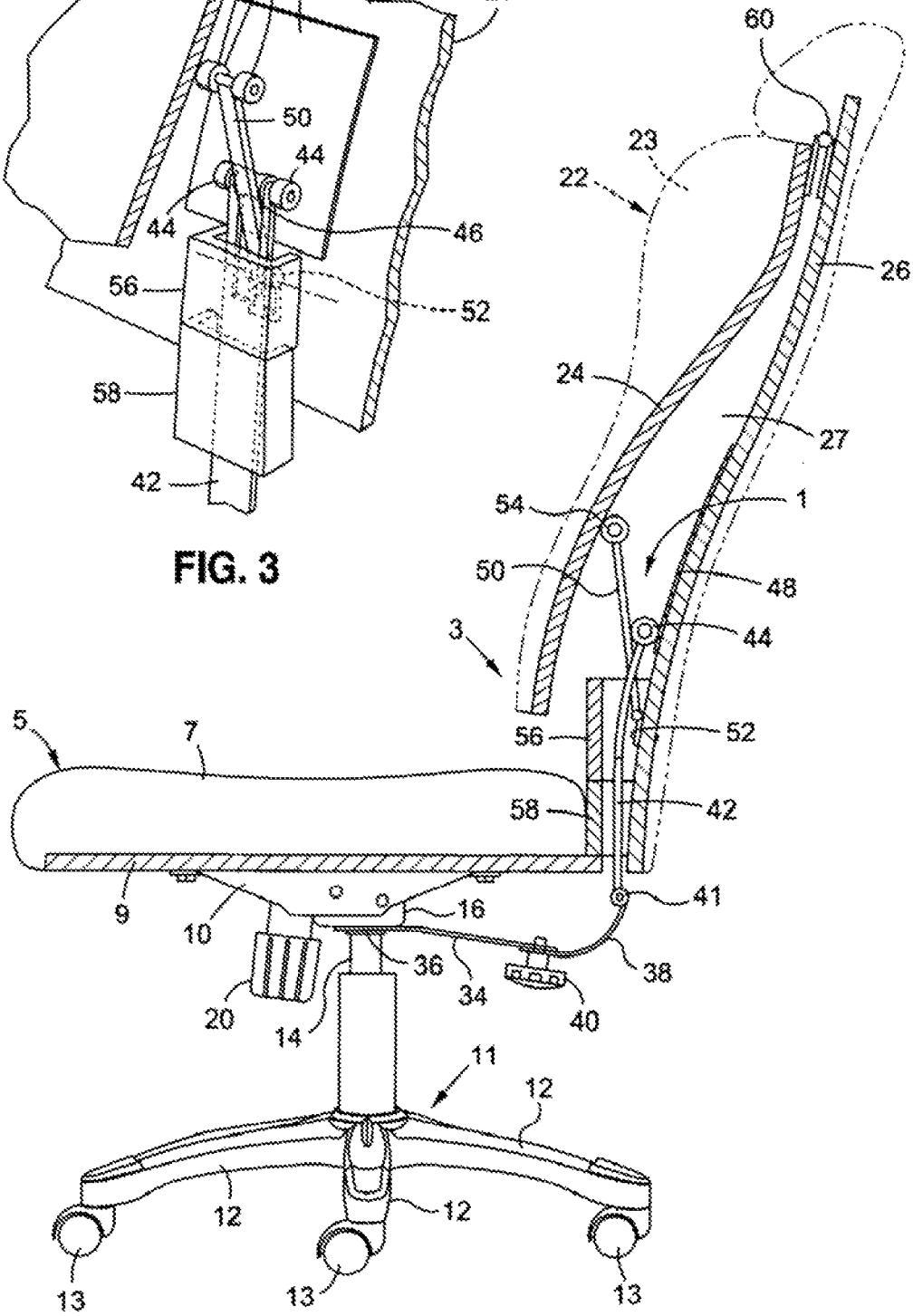
FIG. 2 is a partial cross section of the chair of FIG. 1 rocked forwards and the back support assembly located at a first position inside the back of the chair so that a curved back support protrudes outwardly from the front of the chair back towards the back of a user seated in the chair.

The opposite end of the strap support extension 38 turns upwardly behind the seat 5 and is connected at a hinge 41 to one end of an upstanding force generating strap 42 that is received upwardly through the bottom of the back 22 of the chair 3 between the back support 24 at the front of the chair back and the backing 26 at the rear of the chair back. The opposite free end of the force generating strap 42 is connected to a pair of rollers 44 (best shown in FIGS. 3 and 4). As an important detail of the back support assembly 1 of this invention, the upstanding force generating strap 42 that is received upwardly through the bottom of the chair back 22 will at all times remain stationary in the vertical direction relative to the chair back 22 whether the chair 3 rocks forwards as shown in FIG. 2 or backwards as shown in FIG. 5. However, as shown in FIG. 5, the force generating strap 42 is capable of rotating at the hinge 41 with the chair back 22 when the chair 3 rocks backwards.

Figure 3:
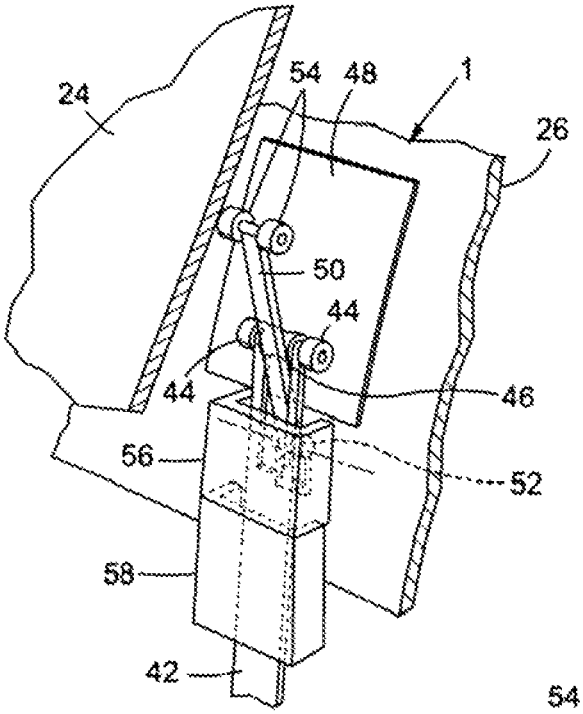
FIG. 3 is an enlarged detail of the back support assembly located inside the back of the chair shown in FIG. 1.
Figure 4:
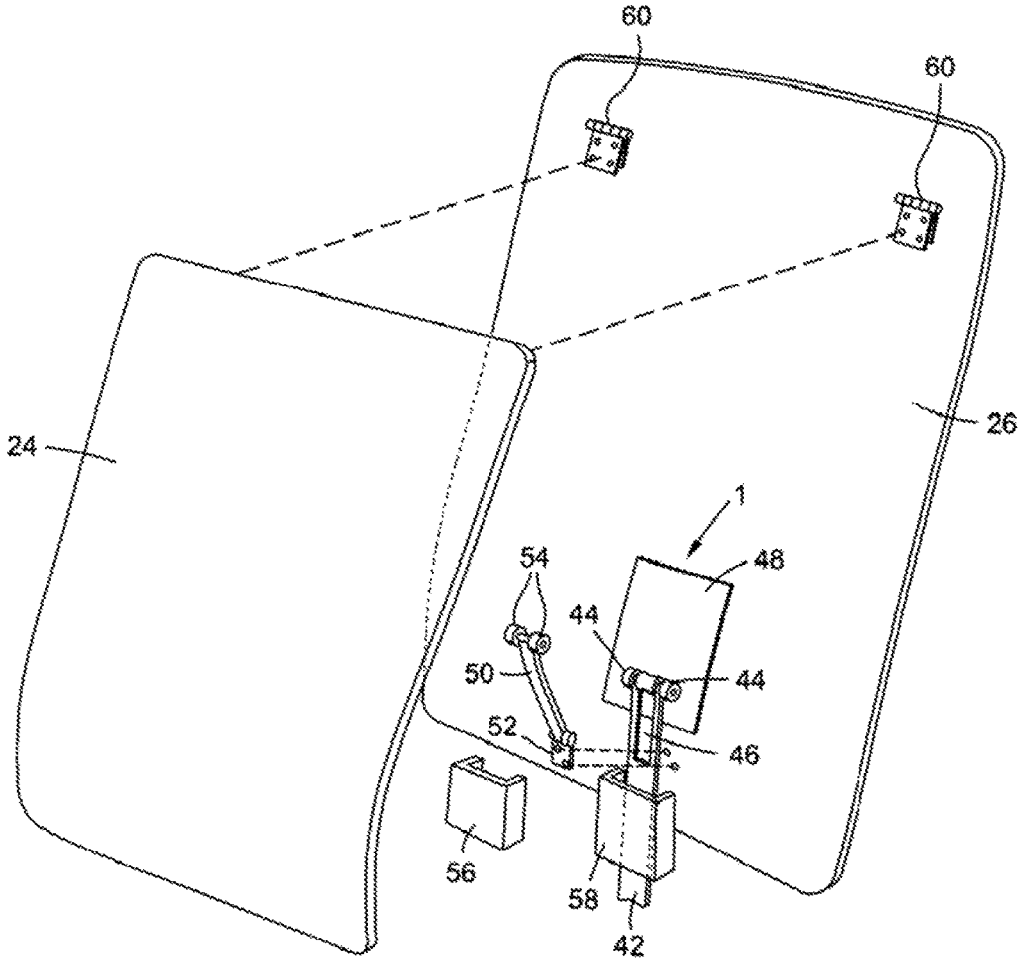
FIG. 4 is an exploded view of the back support assembly shown in FIG. 3.
Figure 5:
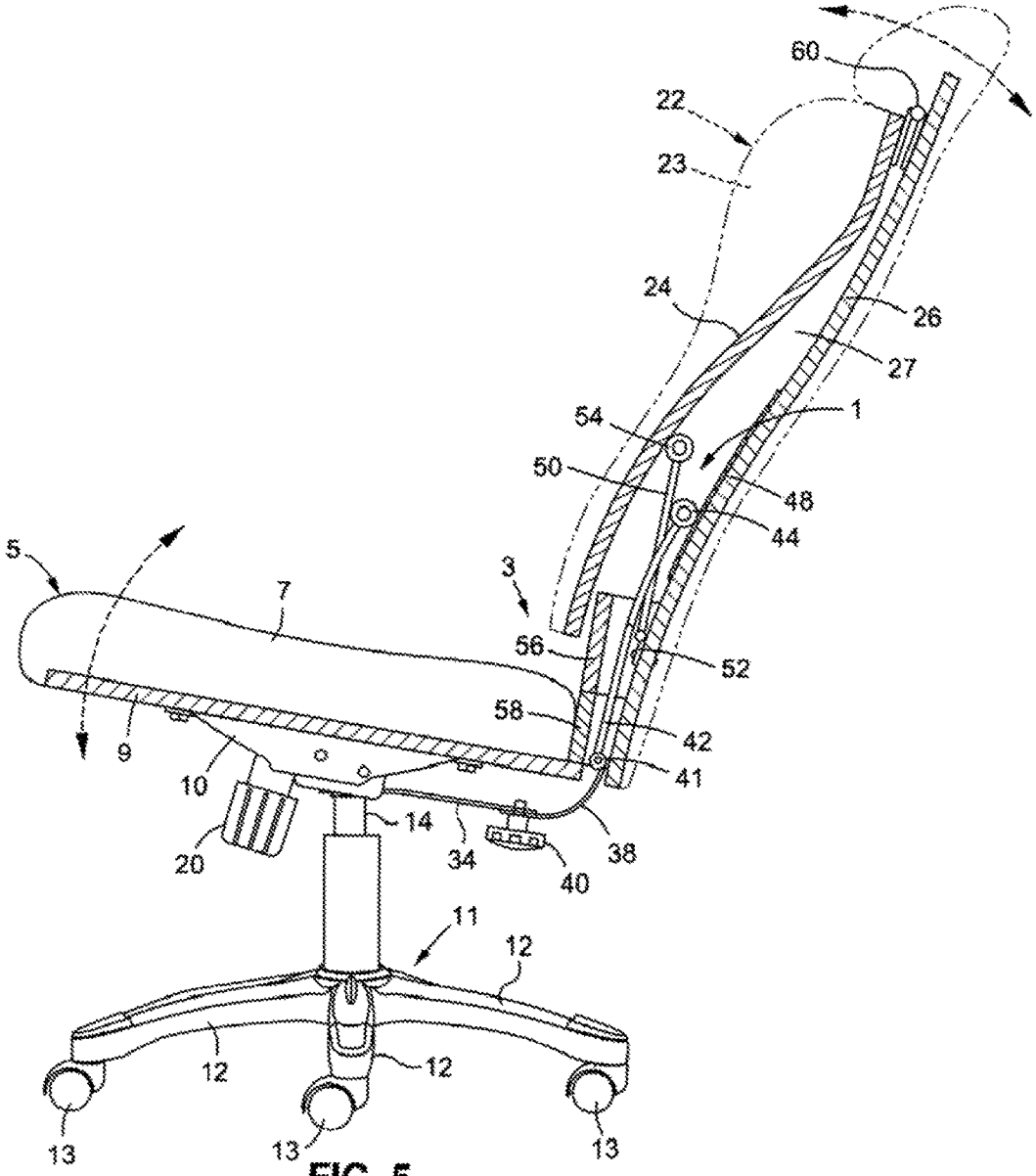
FIG. 5 is a partial cross section of the chair rocked backwards and the back support assembly located at a second position inside the back of the chair so that the curved back support rotates away from the back of the user and towards the rear of the chair back.

Referring briefly to FIGS. 3 and 4 of the drawings, an opening 46 is formed through the force generating strap 42. The purpose of the opening 46 will soon be described. The pair of rollers 44 that are carried by the force generating strap 42 lie across strap 42 above the opening 46. The rollers 44 are located within the chair back 22 so as to lie on a low friction roller pad 48 that is affixed to the inside of the backing 26 at the rear of the chair back opposite the back support 24 at the front of the chair back. The rollers 44 are adapted to roll on the roller pad 48 as the back 22 of the chair 3 tilts back and forth.

Referring once again to FIGS. 1-5, the back support assembly 1 also includes a rotatable back support pushing arm 50 that is located within the bottom of the back 22 of the chair 3 between the back support 24 and the opposing backing 26 thereof. One end of the rotatable back support pushing arm 50 is pivotally coupled to a hinge 52. The hinge 52 is fixedly connected (e.g., screwed) to the inside of the backing 26 so as to lie opposite the back support 24. The opposite free end of the back support pushing arm 50 which extends from the hinge 52 towards the back support 24 carries a pair of rollers 54 (also best shown in FIGS. 3 and 4).

Referring briefly once more to FIGS. 3 and 4, the rotatable back support pushing arm 50 is sized so as to extend through the opening 46 formed in the vertically stationary force generating strap 42, whereby the strap 42 and the arm 50 intersect one another. Thus, the pushing arm 50 extends from the first end thereof which is coupled to the hinge 52 at the backing 26, through the opening 46 in force generating strap 42, to the opposite free end thereof at which the rollers 54 are located. It is important to note that the pair of rollers 54 that are carried by the free end of the rotatable back support pushing arm 50 are located within the chair back 22 so as to lie on and roll over the inside of the back support 24 at the front of the chair back 22 as the chair back tilts backwards and forwards. It is also important to note that the vertically stationary force generating strap 42 and the rotatable back support pushing arm 50 of the back support assembly 1 are held one above the other between the back support 24 at the front of the chair back 22 and the backing 26 at the rear of the chair back 22 such that the pair of rollers 44 that are carried at the free end of the force generating strap 42 will contact and roll on the back support pushing arm 50 as the back 22 of the chair 3 tilts backwards and forwards.

Upper and lower guide boxes 56 and 58 surround the upstanding and vertically stationary force generating strap 42 at the bottom of the chair back 22 to cause the strap 42 to rotate at the hinge 52 as the chair rocks back and forth and the pair of rollers 44 at the free end of strap 42 ride up and down over the roller pad 48 along the inside the backing 26. The upper and lower guide boxes 56 and 58 are affixed to the rigid backing 26 of the chair back 22 and to the rigid seat support 9 below the chair seat 5.

The operation of the back support assembly 1 moving in the aforementioned first direction by which to protrude outwardly from the front of the back 22 of the chair 3 so as to engage and provide support for the back of the user when the chair back tilts forwards and moving in the opposite direction at which the back support assembly 1 is pushed inwardly of the chair back 22 to permit the user to lean completely back and recline against the chair back 22 as the chair back tilts backwards is now described while once again referring concurrently to FIGS. 1-5 of the drawings. As is best shown in FIGS. 2, 4 and 5, the top of each of the back support 24 at the front of the chair back 22 and the opposing backing 26 at the rear of the chair back 22 which are separated from one another by the gap 27 are pivotally coupled to one another by a pair of hinges 60. The curved bottom of the back support 24 is rotatable at the hinges 60 in opposite directions towards and away from the backing 26 to change the size of the gap 27 as the seat 5 and the back 22 of the chair 3 rotate back and forth with one another in the manner shown in FIGS. 2 and 5.

In the case where the user leans forward, the chair 3 rocks forward, and the back 22 of the chair stands substantially upright, the pair of rollers 44 at the free end of the upstanding and vertically stationary (relative to the chair back 22) force generating strap 42 of the back assembly 1 are positioned near the bottom of the roller pad 48 located at the inside of the backing 26 of the chair back 22 (best shown in FIG. 2). The rollers 44 of the force generating strap 42 lie above and press down against the rotatable back support pushing arm 50. The back support pushing arm 50 in turn applies a pushing force, at the pair of rollers 54 thereof, against the inside of the back support 24. Accordingly, the curved bottom of the back support 24 at the front of the chair back 22 is caused to rotate at the pair of hinges 60 in the first direction away from the backing 26 at the rear of the chair back 22 so as to protrude outwardly from the front of the chair back 22 and thereby push the front of the chair back 22 into engagement with the back of the user seated in the chair 3.

In the case where the user leans back and the chair 3 rocks back, the seat 5 and the back 22 of the chair tilt backwards as shown in FIG. 5. At the same time, the upstanding force generating strap 42 rotates backwards at the hinge 41 with the chair back 22. The pair of rollers 44 that are carried at the free end of the force generating strap 42 will now be located upwardly along the low friction roller pad 48 inside the backing 26 at the rear of chair back 22. However, and as was previously explained, because it is connected to the gas cylinder 14 of the base 11 of the chair 3 by way of the strap support 34 and the strap support extension 38, the force generating strap 42 remains stationary in the vertical direction relative to the back 22 of the chair 3 as the user leans back and the chair back 22 tilts backwards.

What is more, because they are connected to one another, as the user leans back in the chair 3, the seat 5 and the back 22 of chair 3 will simultaneously rotate (at the seat control tilt bracket 10) backwards such that the backing 26 of chair back 22 and the roller pad 48 that is attached to the backing 26 move downwardly relative to the upstanding and vertically stationary force generating strap 42. Therefore, the rollers 44 of the force generating strap 42 roll on the roller pad 48. At the same time, the pressure generated by the user's back causes the curved back support 24 at the front of the back 22 of the chair 3 to rotate at the hinges 26 and move in the opposite direction away from the user's back and towards the backing 26 at the rear of the chair back 22.

As the back support 24 rotates at hinges 60 towards the opposing backing 26 in response to the pressure generated when the user leans back in the chair, the back support pushing arm 50 will be correspondingly pushed and caused to rotate at the hinge 52 thereof in a clockwise direction towards the backing 26 and to a second position standing upwardly within the chair back 22. Accordingly, the pair of rollers 54 that are carried by the pushing arm 50 will now roll over and ride upwardly along the inside of the back support 24 at the front of the chair back 22. Likewise, the rollers 44 that are carried by the vertically stationary force generating strap 42 and roll on the roller pad 48 inside the backing 26 at the rear of the chair back 22 will also roll on the rotatable back support pushing arm 50 as the pushing arm 50 rotates at hinge 52 to its second position within the chair back 22 shown in FIG. 5.

It may be appreciated that as the back 22 of the chair 3 tilts backwards and the curved back support 24 at the front of the chair back 22 rotates in the opposite direction inwardly of the chair back 22 and towards the backing 26 at the rear of the chair back 22, the size of the gap 27 between the back support 24 and the backing 26 is reduced. However, the user may now lean completely back within the chair 3 and recline comfortably against the chair back 22 with the curved back support 24 still engaging his back.

Should the user wish to exit or lean forward in the chair 3, he can shift his weight such that the chair 3 will rock forward and the seat 5 and back 22 of the chair 3 will rotate together until the chair back 22 once again stands upright in the manner shown in FIG. 2. At the same time, the backing 26 of the chair back 22 and the roller pad 48 carried by the backing will shift upwardly and away from the vertically stationary force generating arm 42. Accordingly, the rollers 44 carried by the force generating arm 42 will roll on the roller pad 48 and on the back support pushing arm 50 which lies below the force generating arm 42.

In this case, as the chair back 22 tilts forward, the force generating arm 42 will rotate forwards at the hinge 41, and the rollers 44 of the force generating arm 42 will generate a pushing force to cause the back support pushing arm 50 to rotate at the hinge 52 thereof in a counter-clockwise direction downwardly towards the back support 24 at the front of the chair back 22 and to its first position within the chair back 22. The rollers 54 that are carried by the pushing arm 50 will in turn roll over and ride downwardly along the inside of the curved back support 24 to generate a corresponding pushing force against and cause the back support 24 to once again rotate at the hinges 60 in the first direction away from the backing 26 at the rear of the chair back 22 so as to protrude from the front of the chair back 22 towards the back of the user in the manner shown at FIG. 2.

The invention claimed is:

1. A chair adapted to rock back and forth and comprising:

a seat to support the weight of a user seated in the chair;

a base coupled to the seat to hold the seat above the ground; and a back standing upwardly from said seat to support the back of the user, said back coupled to said seat so that said back and said seat tilt back and forth with one another relative to said base when the chair rocks back and forth, wherein the back of said chair includes:

a front having first and opposite ends;

a rear having first and opposite ends and lying opposite and separated from said front by a gap, the respective first ends of the front and the rear of the back of said chair being pivotally coupled to one another, such that said front is rotatable relative to said rear, a back support pushing arm having first and opposite ends and being pivotally connected at the first end thereof to the rear of the back of said chair, said back support pushing arm being located at a first position with respect to the front of the back of said chair at which to apply a pushing force to said front when the seat and the back of said chair tilt forwards to cause the front of the back of said chair to rotate in a first direction away from the rear of the back of said chair and towards the back of the user, whereby the gap between the front and the rear of said back has a first size, said back support pushing arm rotating at the first end thereof with respect to the front of the back of said chair from said first position to a second position when the user leans back and applies a pressure against the back of the chair, the seat and the back of the chair tilt back, and the front of the back of said chair rotates in an opposite direction towards the rear of the back of said chair, whereby the first size of the gap between the front and the rear of said back is reduced, and wherein the back of the chair also includes a force generating strap standing upwardly within said back and lying in contact with said back support pushing arm for urging said back support pushing arm to rotate at the first end thereof from said second position to said first position at which to apply said pushing force to the front of the back of said chair when the seat and the back of said chair tilt forwards.

2. The chair recited in claim 1, wherein the front of the back of said chair is curved to conform to the shape of the back of the user, such that said front protrudes from the back of said chair when the seat and the back of said chair tilt forwards.

3. The chair recited in claim 1, wherein the back of said chair also includes a cover and the front of the back of said chair is surrounded by said cover, such that the front of the back of said chair lies inside said back.

4. The chair recited in claim 1, wherein the respective first ends of the front and the rear of the back of said chair are pivotally coupled to one another by at least one hinge extending therebetween.

5. The chair recited in claim 1, wherein the front of the back of said chair is manufactured from a rigid material.

6. The chair recited in claim 1, wherein the opposite end of said back support pushing arm moves up and down along the front of the back of said chair when said back support pushing arm rotates at said first end thereof between said first and second positions, said pushing arm rotating and moving upwardly along the front of the back of said chair to said second position when the user leans back, the seat and the back of said chair tilt back, and the front of the back of said chair rotates in said opposite direction towards the rear of the back of said chair; and said pushing arm rotating and moving downwardly along the front of the back of said chair to said first position so as to apply said pushing force to the front of the back of said chair to cause said front to rotate in said first direction away from the rear of the back of said chair and towards the back of the user when the seat and the back of said chair tilt forwards.

7. The chair recited in claim 6, wherein said back support pushing arm has at least one roller located at the opposite end thereof, said roller rolling over and moving upwardly and downwardly along the front of the back of said chair when said back support pushing arm rotates at said first end thereof between said first and said second positions.

8. The chair recited in claim 1, wherein said force generating strap has first and opposite ends, the first end of said force generating strap interconnected with the base of said chair below said seat, and the opposite end of said force generating strap located between the front and the rear of the back of said chair so as to lie in contact with and press against said back support pushing arm.

9. The chair recited in claim 8, wherein said force generating strap has an opening formed therein, said back support pushing arm extending through the opening formed in said force generating strap such that said force generating strap and said back support pushing arm intersect one another, and the opposite end of said force generating strap lies in contact with said back support pushing arm.

10. The chair recited in claim 8, wherein the opposite end of said force generating strap has at least one roller lying in contact with said back support pushing arm, the back of said chair moving downwardly towards and upwardly away from said force generating strap when the seat and the back of said chair tilt back and forth for causing the roller of said stationary force generating strap to simultaneously roll on the rear of the back of said chair and on said back support pushing arm.

11. The chair recited in claim 10, wherein the opposite end of said force generating strap is fixedly connected to the base of said chair so that said force generating strap remains stationary in a vertical direction relative to the back of said chair when the back of said chair moves downwardly towards and upwardly away from said force generating strap.

12. The chair recited in claim 10, wherein the rear of the back of said chair has a low friction roller pad attached thereto, the roller at the opposite end of said force generating strap rolling on said low friction roller pad when the seat and the back of said chair tilt back and forth and the back of said chair moves downwardly towards and upwardly away from said force generating strap.

13. A chair adapted to rock back and forth and comprising:

a seat to support the weight of a user seated in the chair;

a base coupled to the seat to hold the seat above the ground; and a back standing upwardly from said seat to support the back of the user, said back coupled to said seat so that said back and said seat tilt back and forth with one another relative to said base when the chair rocks back and forth, wherein the back of said chair includes:

a front having first and opposite ends;

a rear having first and opposite ends and lying opposite and separated from said front by a gap;

a back support pushing arm extending between the front and the rear of the back of said chair and located at a first position with regard to said front at which to apply a pushing force to said front when the seat and the back of said chair tilt forwards to cause the front of the back of said chair to move in a first direction away from the rear of the back of said chair and towards the back of the user, whereby the gap between the front and rear of said back has a first size, the front of the back of said chair being responsive to a pressure generated when the user leans back against the back of said chair and the seat and the back of said chair tilt back with one another to cause the front of the back of said chair to move in an opposite direction away from the back of the user and towards the rear of the back of said chair, whereby the first size of the gap between the front and the rear of said back is reduced and said back support pushing arm moves to a second position with respect to the front of the back of said chair; and a force generating strap located between the front and the rear of the back of said chair and lying in contact with said back support pushing arm to push said back support pushing arm towards said first position and into engagement with the front of the back of said chair when the seat and the back of the chair tilt forwards.

14. The chair recited in claim 13, wherein the respective first ends of the front and the rear of the back of said chair are pivotally coupled to one another such that the front of the back of the chair is rotatable in said first and opposite directions relative to the rear of the back of the chair so as to move towards and away from the back of the user seated in the chair when the seat and the back of the chair tilt back and forth.

15. The chair recited in claim 14, wherein said back support pushing arm has first and opposite ends, the first end of said back support pushing arm being pivotally connected to the rear of the back of said chair by a hinge, such that said back support pushing arm rotates at said hinge between said first and second positions so as to apply said pushing force to the front of the back of said chair to cause the front of the back of said chair to rotate in said first direction when the seat and the back of said chair tilt forwards and said back support pushing arm rotates to said first position.

16. The chair recited in claim 15, wherein said force generating strap has first and opposite ends, the first end of said force generating strap interconnected with the base of said chair below said seat, and the opposite end of said force generating strap located between the front and the rear of the back of said chair and lying in contact with said back support pushing arm.

17. The chair recited in claim 16, wherein said force generating strap has an opening formed therein, said back support pushing arm extending through the opening formed in said force generating strap such that said force generating strap and said back support pushing arm intersect one another, and the opposite end of said force generating strap lies in contact with and pushes said back support pushing arm towards said first position and into engagement with the front of the back of said chair when the seat and the back of said chair tilt forwards.

18. The chair recited in claim 16, wherein the first end of said force generating strap is fixedly connected to the base of said chair, and the opposite end of said force generating strap has at least one roller lying in contact with said back support pushing arm, the back of said chair moving downwardly towards and upwardly away from said force generating strap when the seat and the back of said chair tilt back and forth such that said force generating strap remains stationary in a vertical direction relative to the back of said chair when the back of said chair moves downwardly towards and upwardly away from said force generating strap for causing the roller at the opposite end of said force generating strap to simultaneously roll on the rear of the back of said chair and on said back support pushing arm.

19. A chair adapted to rock back and forth and comprising:

a seat to support the weight of a user seated in the chair;

a base coupled to the seat to hold the seat above the ground; and a back standing upwardly from said seat to support the back of the user, said back coupled to said seat so that said back and said seat tilt back and forth with one another relative to said base when the chair rocks back and forth, wherein the back of said chair includes:

a front having first and opposite ends;

a rear having first and opposite ends and lying opposite and separated from said front by a gap, the respective first ends of the front and the rear of the back of said chair being pivotally coupled to one another, such that said front is rotatable relative to said rear; and a back support pushing arm having first and opposite ends and being pivotally connected at the first end thereof to the rear of the back of said chair, said back support pushing arm being located at a first position with respect to the front of the back of said chair at which to apply a pushing force to said front when the seat and the back of said chair tilt forwards to cause the front of the back of said chair to rotate in a first direction away from the rear of the back of said chair and towards the back of the user, whereby the gap between the front and the rear of said back has a first size, said back support pushing arm rotating at the first end thereof with respect to the front of the back of said chair from said first position to a second position when the user leans back and applies a pressure against the back of the chair, the seat and the back of the chair tilt back, and the front of the back of said chair rotates in an opposite direction towards the rear of the back of said chair, whereby the first size of the gap between the front and the rear of said back is reduced, and said back support pushing arm having at least one roller located at the opposite end thereof, said roller rolling over and moving upwardly and downwardly along the front of the back of said chair when said back support pushing arm rotates between said first and said second positions.

20. The chair recited in claim 19, wherein the back of said chair also includes a force generating strap standing upwardly within said back and lying in contact with said back support pushing arm for urging said back support pushing arm to rotate at the first end thereof from said second position to said first position at which to apply said pushing force to the front of the back of said chair when the seat and the back of said chair tilt forwards, said force generating strap having first and opposite ends, the first end of said force generating strap interconnected with the base of said chair below said seat, and the opposite end of said force generating strap located between the front and the rear of the back of said chair so as to lie in contact with said back support pushing arm.

* * * * *